US005555570A

United States Patent [19]

Bay, Jr.

[11] Patent Number: 5,555,570

[45] Date of Patent: Sep. 17, 1996

[54] BICYCLE HELMET FACE SHIELD APPARATUS AND METHOD

[76] Inventor: William P. Bay, Jr., 46 S. St. Andrews, Ormond Beach, Fla. 32174

[21] Appl. No.: 414,326

[22] Filed: Mar. 31, 1995

[51] Int. Cl.[6] ..... A42B 3/22

[52] U.S. Cl. ..... 2/424; 2/422

[58] Field of Search ..... 2/9, 10, 424, 425, 2/422, 410, 436

[56] References Cited

U.S. PATENT DOCUMENTS

| | | | |
|---|---|---|---|
| 4,141,085 | 2/1979 | Adams, Sr. | 2/410 |
| 4,287,615 | 9/1981 | Morin | 2/424 |
| 4,622,700 | 11/1986 | Sundahl | 2/425 |
| 4,625,341 | 12/1986 | Broersma | 2/424 |
| 4,653,123 | 3/1987 | Broersma | 2/425 |
| 4,884,302 | 12/1989 | Foehl | 2/424 |
| 4,951,316 | 8/1990 | Moody | 2/10 |
| 5,010,598 | 4/1991 | Flynn et al. | 2/410 |
| 5,067,174 | 11/1991 | Ritchey et al. | 2/10 |
| 5,121,507 | 6/1992 | Brown | 2/199 |
| 5,177,810 | 1/1993 | Minton et al. | 2/425 |
| 5,363,512 | 11/1994 | Grabos, Jr. et al. | 2/436 |
| 5,365,615 | 11/1994 | Piszkin | 2/424 |

FOREIGN PATENT DOCUMENTS

| | | | |
|---|---|---|---|
| 8604790 | 8/1986 | WIPO | 2/424 |

*Primary Examiner*—Michael A. Neas
*Attorney, Agent, or Firm*—William M. Hobby, III

[57] ABSTRACT

A method of removably attaching a bicycle helmet face shield to a bicycle helmet includes the steps of selecting a bicycle helmet and a bicycle helmet transparent shield having a plurality of openings therein and selecting a resilient shield attaching member having a plurality of elongated slots formed therein. One slot in the resilient shield attaching member may be placed at an angle to a second slot or an angled back may be provided the shield attaching member to adjust the shield angle in front of the biker's face. The selected resilient shield is adhesively attached to the bicycle helmet and the shield is attached in one of the elongated slots. A bicycle helmet face shield apparatus includes the face shield attaching member having a plurality of slots formed in a resilient material and having one of the slots placed parallel to the second slot and having a transparent face shield removably attached in one or the other slots of the face shield attaching member attached to a bicycle helmet.

13 Claims, 2 Drawing Sheets

BICYCLE HELMET FACE SHIELD APPARATUS AND METHOD

BACKGROUND OF THE INVENTION

The present invention relates to a bicycle helmet face shield and to a method of attaching a bicycle helmet face shield to a bicycle helmet.

In the past, it has been common to provide helmets and face shields for motorcycles and more recently safety helmets for bicycle riders have become common. Safety helmets of this type are commonly molded with a hard plastic material having an inner close fitting foamed polymer liner. In case of an accident, the helmet is capable of withstanding the shock loads by the hard plastic shell of the helmet along with the resilience in the foam lining so that the force is more evenly spread over a wider area and dissipated by the foamed polymer to reduce the dangers of concussion to the biker. While helmets have been commonly provided with shields for motorcycle riders, bicycle helmets typically have not been provided with face shields and these helmets are designed differently from those provided for motorcycle users. It has also been common to make bicycle helmets ventilated to provide some cooling of the head. More recently, it has been suggested to provide face or eye shields for the bike rider. It has also been suggested to provide shields which allows the passage of air past the shield and through the ventilated helmet to continue the cooling.

Prior U.S. Patents which include ventilated helmets and which have face shields may be seen in the Adams, Sr. patent, U.S. Pat. No. 4,141,085, for a vented helmet and face shield in which the safety helmet has a plurality of air vents formed in the helmet and has a face shield with a plurality of air vents formed therein. In the Sundahl patent, U.S. Pat. No. 4,622,700, a suction ventilated helmet for a cyclist is provided with a visor. The Flynn et al. patent, U.S. Pat. No. 5,010,598, provides a safety helmet which also has air vent apertures formed therein and includes a drop-down visor and shield. Other prior art patents which have various means of attaching visors or other accessories to headgear may be seen in the Ritchey et al. patent, U.S. Pat. No. 5,067,174, for protective head gear which is for a head dress for health care professionals to prevent contact with contaminants but provides removable coverings which can be attached to the headgear. In the Moody patent, U.S. Pat. No. 4,951,316, a sun visor with an eye shield is provided in which the eye shield can be attached to the visor with a single clip by inserting the visor into the clip. The Brown patent, U.S. Pat. No. 5,121,507, is a headwear accessory attachment in which a neck covering can be attached with VELCRO and clips to the back of a cap. In the Morin patent, U.S. Pat. No. 4,287,615, a helmet has a withdrawable shield for a ski crash helmet.

The present invention deals with a bicycle helmet and especially to a face shield which may be attached to an existing bicycle helmet with an easy attachable universal strip which may be adhesively attached to the front of the helmet and has one or several slots formed in a resilient material in which at least two of the slots are formed parallel to each other so that the helmet shield can be press fitted into one or any of the other of the slots. An alternate embodiment attaches a curved piece of resilient material to the front crown or leading edge of a helmet for insertion of a shield thereinto.

SUMMARY OF THE INVENTION

A method of removably attaching a bicycle helmet face shield to a bicycle helmet includes the steps of selecting a bicycle helmet and a bicycle helmet transparent shield having a plurality of openings therein and selecting a resilient shield attaching member having a plurality of elongated slots formed therein. One slot in the resilient shield attaching member may be placed at an angle to a second slot or an angled back may be provided as the shield attaching member to adjust the shield angle in front of the biker's face. The selected resilient shield attaching member is adhesively attached to the bicycle helmet and the shield is attached in one of the elongated slots. A bicycle helmet face shield apparatus includes the face shield attaching member having a plurality of slots formed in a resilient material and having one of the slots placed parallel to the second slot and having a transparent face shield removably attached in one or the other slots of the face shield attaching member attached to a bicycle helmet.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
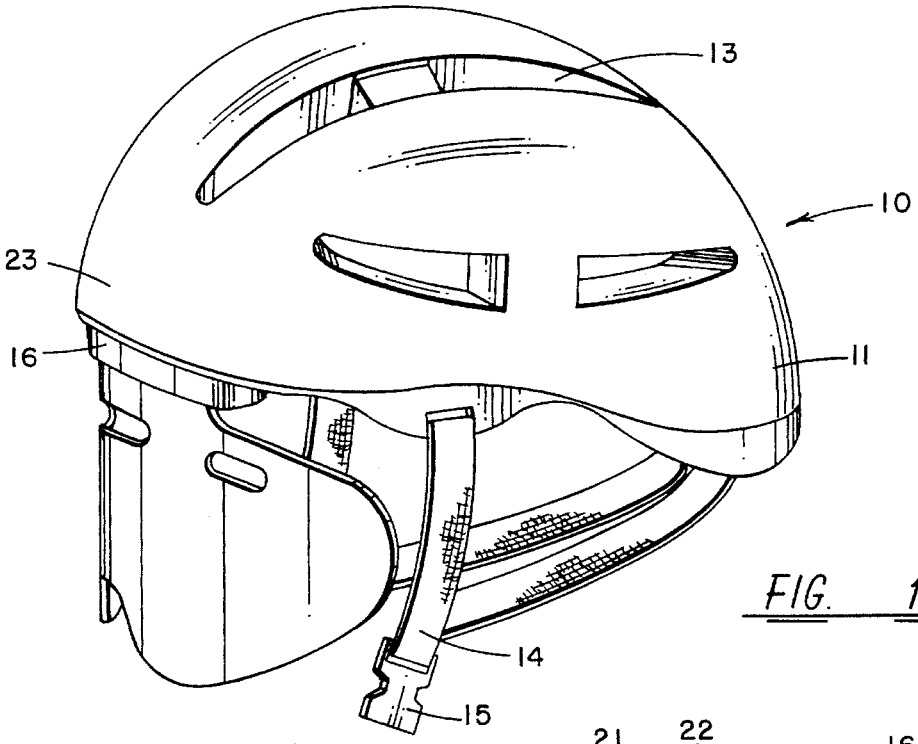
FIG. 1 is a perspective view of a bicycle helmet having the face shield and face shield attachment in accordance with the present invention attached thereto.
Figure 2:
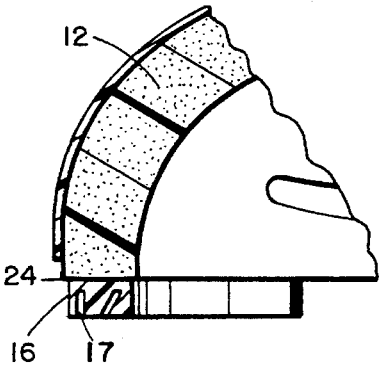
FIG. 2 is a sectional view taken through the front section of the bicycle helmet of FIG. 1.
Figure 3:
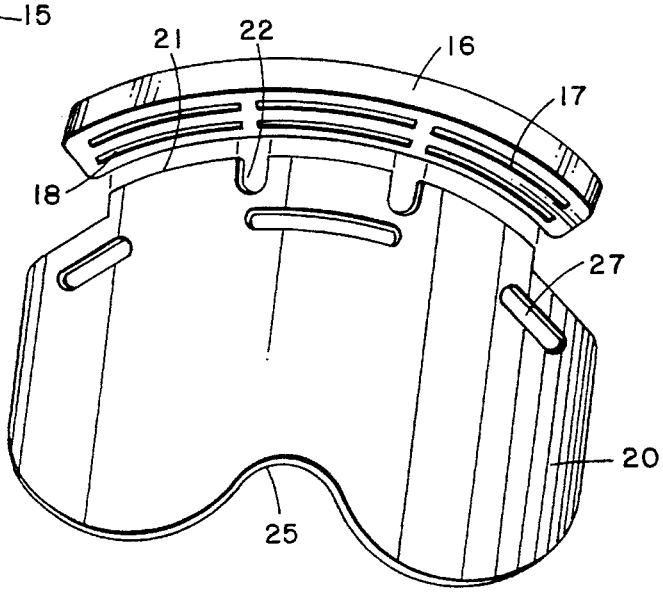
FIG. 3 is an exploded view of the bicycle helmet shield and shield attaching member of FIG. 1.

Referring to the drawings and especially to FIGS. 1–3, a bicycle helmet 10 is illustrated in FIG. 1 having a hard polymer shell 11 lined with a thick resilient foam 12 and having a plurality of air vents 13 therein. The helmet is held to the rider's head with straps 14 and strap fasteners 15. The helmet, as shown in FIG. 1, is typical of helmets for use by bikers which include ventilation for cooling the head since a biker expends a great deal of energy in pedaling the bike, and the ventilation provides extra cooling.

The helmet, in FIG. 1, has a shield attaching member 16 adhesively attached thereto and is made of a resilient material, such as rubber or a resilient polymer, and is formed in an arcuate manner, as shown in FIG. 3, but because of its resilient nature, the curve may be adjusted for any particular helmet by merely bending the shield attaching member 16 to fit the helmet. Shield attaching member 16 has a first set of arcuate slots 17 formed therein which generally extends parallel to the member 16 sides and a second set of three slots 18 on the inside and parallel to the slots 17 but which may extend at an angle to the parallel slots 17, as shown in FIG. 2. The shield 20 has a shield attaching edge 21 having but not limited to multiple notches 22 cut therein to form the attaching edge in three parts which can be inserted into the slots 17 to extend straight down from the shield attaching member 16 when attached to a helmet 11. Shield attaching member 16 is attached to the front portion 23 of the helmet 11 and is attached to the surface 24 of the foam polymer lining 12 so as to align the shield attaching member 16 in front of the biker's face. When the shield 20 is inserted into the slots 17 or 18, the shield will extend in front of the biker's face or at least to cover his eyes and may have a shape having an inset area 25 to extend over the wearer's nose. The member 16 is shown with segmented slots for strength but could be made unsegmented. The rapid changing press fitted shield allows for the changing of the shield from a tinted shield in the daytime to a clear shield at night or the use of two shields together, one tinted and one untinted. The tinted shield can be removed at night.

Figure 5:
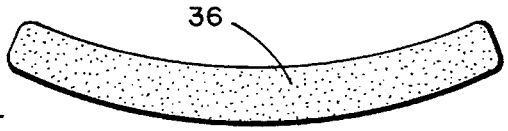
FIG. 5 is a top elevation of a bicycle shield attaching member.

The shield attaching member 16 may have an adhesive surface 26, as shown in FIG. 5, with a wax paper covering which may be peeled off by a purchaser and bent to the proper curvature and attached to the foam surface 24 on the front 23 of the helmet 10. The transparent shield 20 may be made flat and then bent to a curvature to fit within the slots 17 or 18 and may be formed with a plurality of vent openings 27 for allowing the passage of air through the face shield past the head and out the vents 13 of the helmet 10.

The attaching member 16 is made of a resilient material, such as a stiff rubber, and the slots 17 and 18 are formed having a thickness which allow a tight press fit of the shield edges 21 thereinto. The slots 17 or 18 are expanded slightly by the insertion of the edges 21 to give a tight fit without additional support for holding the shield in place on the biker's helmet 10.

Figure 4:
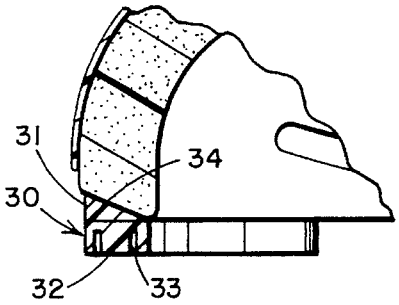
FIG. 4 is a sectional view of a second embodiment taken through the front of the bicycle helmet and attachment member.

Depending on the angle of the surface 24, the slots 17 may place the shield mounting member 16 at an angle so that the slots 17 is at an angle facing into the wearer's face on some helmets. The second set of slots 18 placed at a different angle to the slots 17 allow the shield to be bent and slid into the angled slots 18 to place the shield 20 at a different angle, which may be straight down for an angular mount 24. Alternatively, an angled or wedged shaped face shield attaching member 30 can be seen in the embodiment of FIG. 4 which may have a removable wedge 31 attached to the main face shield attaching portion 32 so that a pair of parallel slots 33 can have their angles adjusted by leaving the wedge 31 attached thereto or by removing the wedge 31. The attaching member can still have an adhesive surface 26, as in FIG. 5, and the wedge portion 31 can have a similar adhesive portion attached to the angled surface 34. A pair of slots are still desirable because it allows the spacing of the shield from the biker's face in two different positions to prevent the shield from being too close to the user's face. The two lens slots also allow for inserting two shields for racing use so that one can be removed when dirty or at night where one is a tinted lens. The front lens would absorb the cold air blast leaving the shield closest to the face less apt to fog up from the weather.

The method in accordance with the present invention includes selecting a bicycle safety helmet face shield attaching member 16 or 30 and removing an adhesive cover 26, then bending the face shield attaching member 16 to the shape of the helmet 10 lining 12 on the front of the helmet and attaching the face shield attaching member thereto. A matching face shield 20 having a smooth surface 21 with notches 22 to match the number of slots in each parallel row of slots, either 17 or 18, is selected and the shield 20 is curved to the curvature of the slots 17 or 18 to allow the shield 20 to be inserted into the slots 17 or 18. Further steps might include the attaching or removing of the wedge-shaped member 31 to position the face shield attaching member 32 and slots 33 at an angle for the face shield 20 to extend over the eyes of the helmet wearer.

Figure 6:
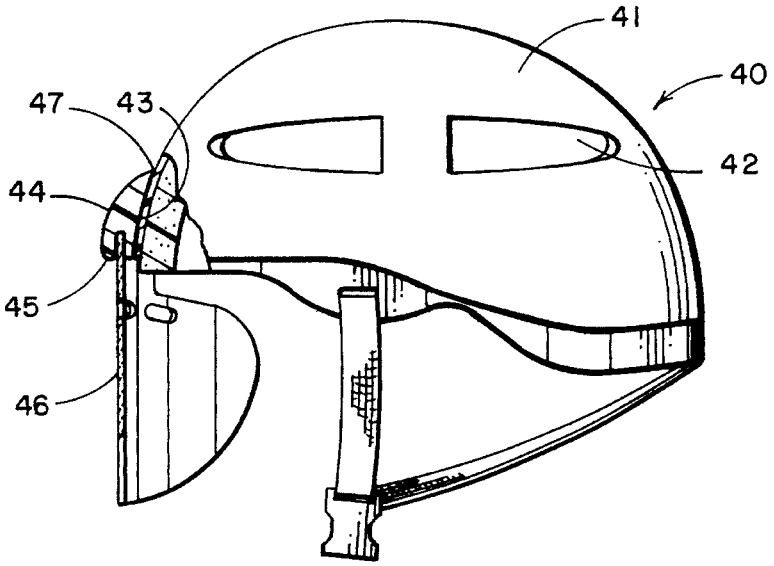
FIG. 6 is a side elevation of a bicycle helmet having an alternate embodiment of a face shield and face shield attachment in accordance with the present invention.
Figure 7:
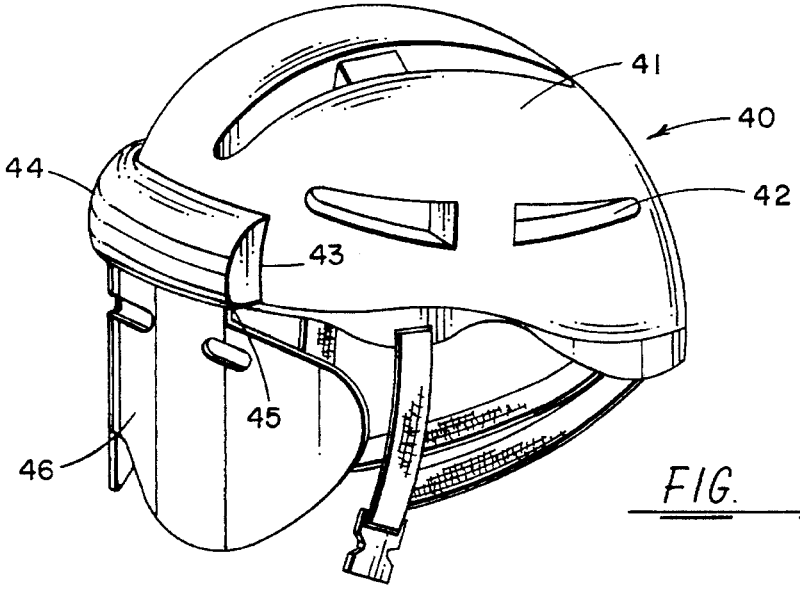
FIG. 7 is a partial perspective of a bicycle helmet shield attachment in accordance with FIG. 6.

Turning now to FIGS. 6 and 7 of the drawings, another embodiment 40 of a bicycle helmet 41 having a shield attachment 44 and shield 46 attached thereto is illustrated. The shield attaching member 44 can be adhesively attached with an adhesive 47 to the front 43 of the bicycle helmet 41. The shield attaching member 44 is made of a resilient material, such as rubber or a resilient polymer, and is formed in an arcuate manner, as shown in FIG. 7, and can, because of its resilient nature, be curved to adjust for any particular bicycle helmet by bending the shield attaching member 44 to fit the front 43 of the helmet. The shield attaching member 44 has an arcuate slot 45 formed slightly smaller than the top edge of the shield member 46 so that the shield can be press fitted into the resilient rubber shield attaching member 44. Shield 44 can be rapidly attached and removed from the front of the bike helmet 41. Bike helmet 41 has air openings 42 to allow the passage of air and the shield 46 can have air passages and can be the same shield as shown in connection with FIGS. 1 and 3.

Figure 8:
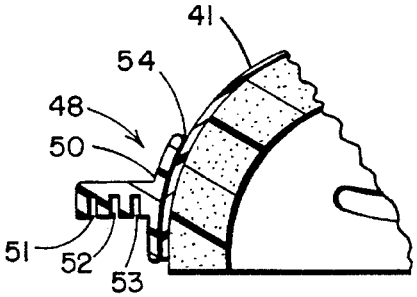
FIG. 8 is a partial sectional view of another embodiment of a face shield and face shield attachment for a bicycle helmet.

Turning now to FIG. 8, yet another embodiment is illustrated similar to the one shown in FIGS. 6 and 7 but having a shield attaching member 48 for attaching to the helmet 41 with an adhesive 54 coated on the back of the shield attaching portion 50. The shield attaching portion 50, in this case, has an enlarged planar area to provide a greater support to the shield attaching member 48. Shield attaching member 48, in this case, has a plurality of arcuate slots 51, 52, and 53 formed therein in spaced positions. The attaching member 48 is made of a resilient hard rubber or a polymer and the slots 51, 52, and 53 are sized slightly smaller than the edge of the shield 46 so that the edge of the shield can be press fitted into any one of the slots to position the shield at predetermined distances from the front of the bicycle helmet 41. The press fitted shields can be rapidly exchanged so that tinted shields used during the daytime can be switched for a clear shield for nighttime use.

It should be clear at this point that a face shield and face shield attaching member to fit most bicycle helmets has been provided which allows for the easy attachment and removal of the shield to the helmet and allows the shield to be attached to a great variety of different helmets. However, the present invention is not to be construed as limited to the forms shown which are to be considered illustrative rather than restrictive.

I claim:

1. A method of removably attaching a bicycle helmet face shield to a bicycle helmet comprising the steps of:

selecting a bicycle helmet having a front edge portion;

selecting a bicycle helmet transparent shield having a predetermined attaching edge thereon;

selecting a resilient shield attaching member having a plurality of parallel elongated slots therein;

bending said selected resilient shield attaching member to the general curvature of a bicycle helmet front portion and attaching said shield attaching member to said bicycle helmet front edge portion in a curved position with said plurality of slots therein facing downward from said helmet; and attaching said shield in at least one of said parallel elongated slots in said resilient shield, whereby a bicycle shield can be removably attached to a bicycle helmet in one of a plurality of positions on to the helmet.

2. A method of removably attaching a bicycle helmet face shield to a bicycle helmet in accordance with claim 1 in which the step of attaching said selected resilient shield attaching member to said bicycle helmet front edge portion includes adhesively attaching said resilient shield attaching member to said bicycle helmet.

3. A method of removably attaching a bicycle helmet face shield to a bicycle helmet in accordance with claim 1 in which the step of selecting a resilient shield attaching member includes selecting a resilient shield attaching member having adhesive over one surface covered with removable cover, whereby the cover can be removed and the resilient shield attaching member attached to a bicycle helmet.

4. A method of removably attaching a bicycle helmet face shield to a bicycle helmet in accordance with claim 1 in which the step of selecting a resilient shield attaching member includes selecting a resilient shield attaching member having one said parallel elongated slot being placed at an angle to the second parallel elongated slot.

5. A method of removably attaching a bicycle helmet face shield to a bicycle helmet in accordance with claim 1 in which the step of selecting a resilient shield attaching member includes selecting a resilient shield attaching member having an angled wedged shaped surface on one side thereof.

6. A method of removably attaching a bicycle helmet face shield to a bicycle helmet in accordance with claim 1 in which the step of selecting a resilient shield attaching member includes selecting a resilient shield attaching member having a removable angled wedged shaped surface removably attached on one side thereof.

7. A method of removably attaching a bicycle helmet face shield to a bicycle helmet in accordance with claim 1 in which the step of selecting a resilient shield attaching member includes selecting a rubber shield attaching member.

8. A method of removably attaching a bicycle helmet face shield to a bicycle helmet in accordance with claim 1 in which the step of selecting a bicycle helmet transparent shield includes selecting a bicycle helmet shield having a plurality of openings therein.

9. A method of removably attaching a bicycle helmet face shield to a bicycle helmet in accordance with claim 1 in which the step of selecting a bicycle helmet transparent shield includes selecting a flat bicycle helmet shield and bending to the curvature of the attached bicycle helmet shield attaching member.

10. A bicycle helmet face shield comprising:

a face shield attaching member having a plurality of slots therein formed in a resilient material, one said slot being parallel and angled to a second said slot; and a transparent face shield member having a plurality of openings therein and a smooth attaching edge removably attached in at least one of said face shield attaching member slots; whereby said transparent face shield can be removably attached in either said one said slot or said second said slot for mounting at different angles to a bicycle helmet.

11. A bicycle helmet face shield in accordance with claim 10 in which said face shield attaching member is adhesively coated on one side thereof.

12. A bicycle helmet face shield in accordance with claim 10 in which said resilient shield attaching member has an angled wedged shaped surface on one side thereof.

13. A bicycle helmet face shield in accordance with claim 10 in which said resilient shield attaching member has a removable angled wedged shaped surface removably attached on one side thereof.

* * * * *